US007063433B2

(12) United States Patent
Pape et al.

(10) Patent No.: US 7,063,433 B2
(45) Date of Patent: Jun. 20, 2006

(54) LIGHT FOR PATIO UMBRELLA

(75) Inventors: Robert J. Pape, Ponte Vedra Beach, FL (US); Jason D. Patz, Jacksonville, FL (US)

(73) Assignee: Hunter Fan Company, Memphis, TN (US)

( * ) Notice: Subject to any disclaimer, the term of this patent is extended or adjusted under 35 U.S.C. 154(b) by 172 days.

(21) Appl. No.: 10/751,557

(22) Filed: Jan. 5, 2004

(65) Prior Publication Data

US 2005/0146868 A1 Jul. 7, 2005

(51) Int. Cl.
*A45B 3/02* (2006.01)

(52) U.S. Cl. ..... 362/102; 362/577; 135/910

(58) Field of Classification Search ..... 362/565, 362/102, 431, 191, 234, 184, 153, 577, 352, 362/450; 135/910, 161, 16; 248/524; 40/571
See application file for complete search history.

(56) References Cited

U.S. PATENT DOCUMENTS 2,087,537 A * 7/1937 Finkel ..... 362/102
5,463,535 A * 10/1995 Vest ..... 362/102
5,584,564 A * 12/1996 Phyle ..... 362/102

* cited by examiner

*Primary Examiner*—Ali Alavi
*Assistant Examiner*—Bao Q. Truong
(74) *Attorney, Agent, or Firm*—Baker Donelson

(57) ABSTRACT

A light (10) is disclosed for use with a patio umbrella (11) having a central pole (14). The light has an external housing (25) and an internal light source (26). The external housing includes an annular base plate (27), an annular dome shaped light diffuser (28), a tubular pole guide (29) having a central bore (31), and a locking ring (32). It should be understood that the umbrella pole (14) has a select diameter which is smaller than the bore of the pole guide.

7 Claims, 2 Drawing Sheets

LIGHT FOR PATIO UMBRELLA

TECHNICAL FIELD

This invention relates to lights and specifically to lights that are used in conjunction with large, patio umbrellas.

BACKGROUND OF THE INVENTION

Large outdoor umbrellas are oftentimes referred to as market or patio umbrellas. These patio umbrellas have become increasingly popular as more and more people are beginning to conduct more outdoor activities. For example, outdoor dinner parties and events are becoming more common, and patio umbrellas have been useful in providing shade to tables and chairs that have been placed outdoors for these events. Outdoor events that are held in the evenings, when the sun has set, usually need to address the problem of providing sufficient lighting to the location of the event. In this regard, separate lighting systems had to be provided to illuminate the location of the event.

Unfortunately, these separate lighting systems can be bulky and difficult to set up. In addition, these conventional lighting systems do not always provide sufficient illumination to the space under the canopy of a patio umbrella.

Small conventional lamps may be placed upon the table to illuminate the area beneath the canopy. However, these lamps take up a large amount of space upon rather small sized patio tables. Furthermore, these lamps are susceptible to being accidently knocked or pulled off the table by those sitting at the table or by those walking by the table and accidently catching their electric cords.

A recent solution to this lighting problem has included the use of a string of lights mounted along the radial ribs of the umbrella. These light stings are mounted to the ribs by forming a groove in the bottom side of each rib within which the string of lights is press fitted. While this provides illumination to the underside of the umbrella the umbrella must be specifically manufactured to include the groove to accept the lighting.

It thus is seen that a need remains for a light which may be used in conjunction with a standard patio umbrella and which is not susceptible to being accidently knocked off the table. Accordingly, it is to the provision of such that the present invention is primarily directed.

SUMMARY OF THE INVENTION

In a preferred form of the invention, a light for use in conjunction with an patio umbrella having a central pole comprises a housing and a light source. The housing has a central bore sized and shaped to receive the central pole of an patio umbrella. At least a portion of the housing is translucent. The light source is mounted within the housing and positioned to direct light through the translucent portion. With this construction, the umbrella central pole is positioned within the central bore of the housing to prevent lateral movement of the light relative to the central pole.

DETAILED DESCRIPTION

Figure 1:
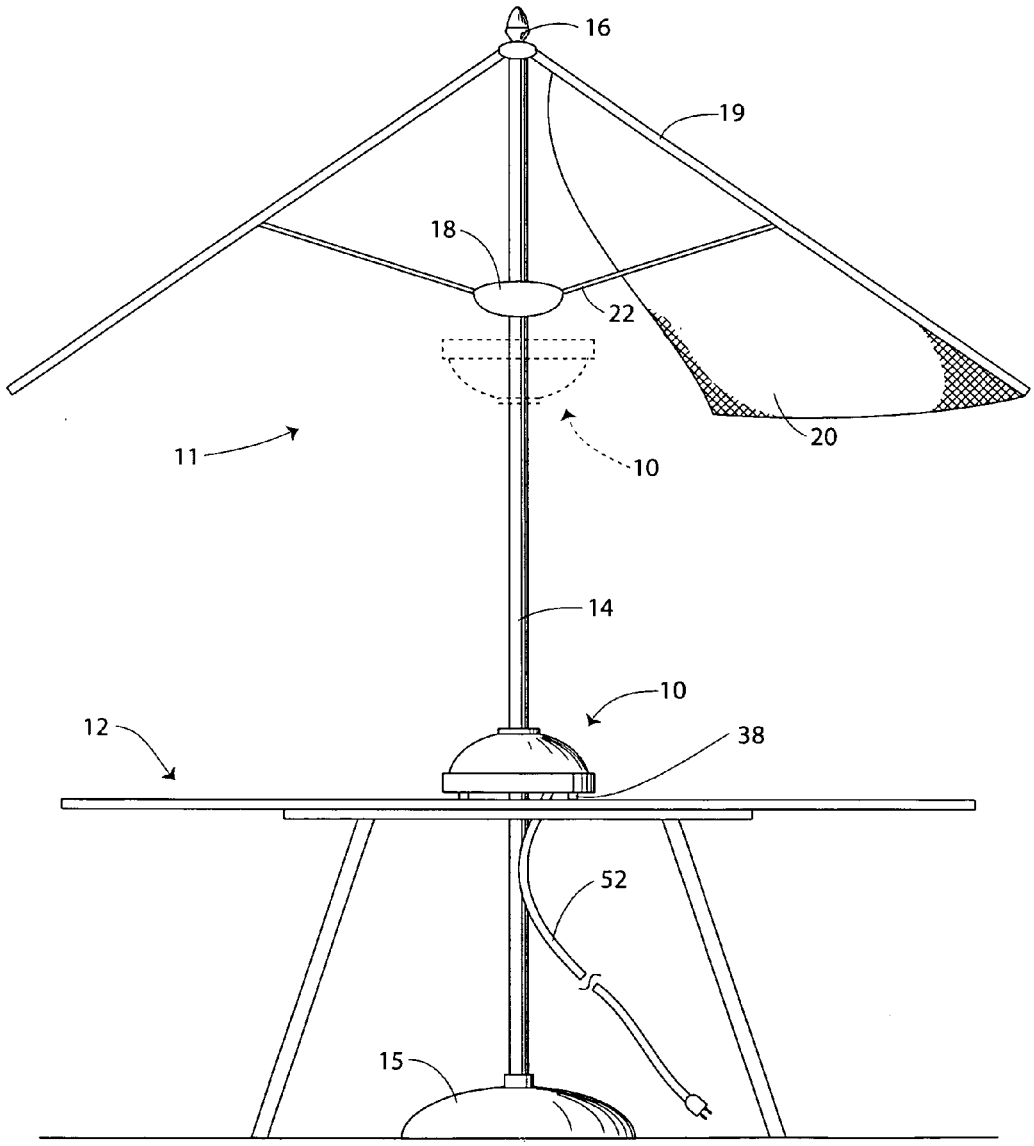
FIG. 1 is a side view of a light embodying principles of the invention in a preferred form, shown mounted to a patio umbrella and table.
Figure 2:
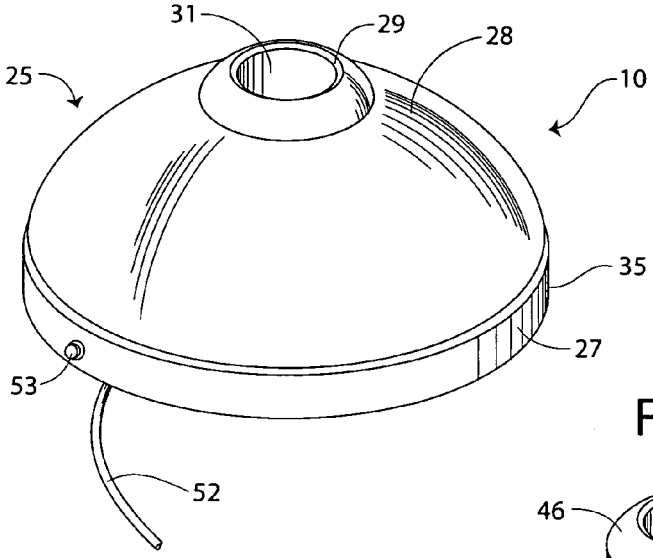
FIG. 2 is a perspective view of the light of FIG. 1.
Figure 3:
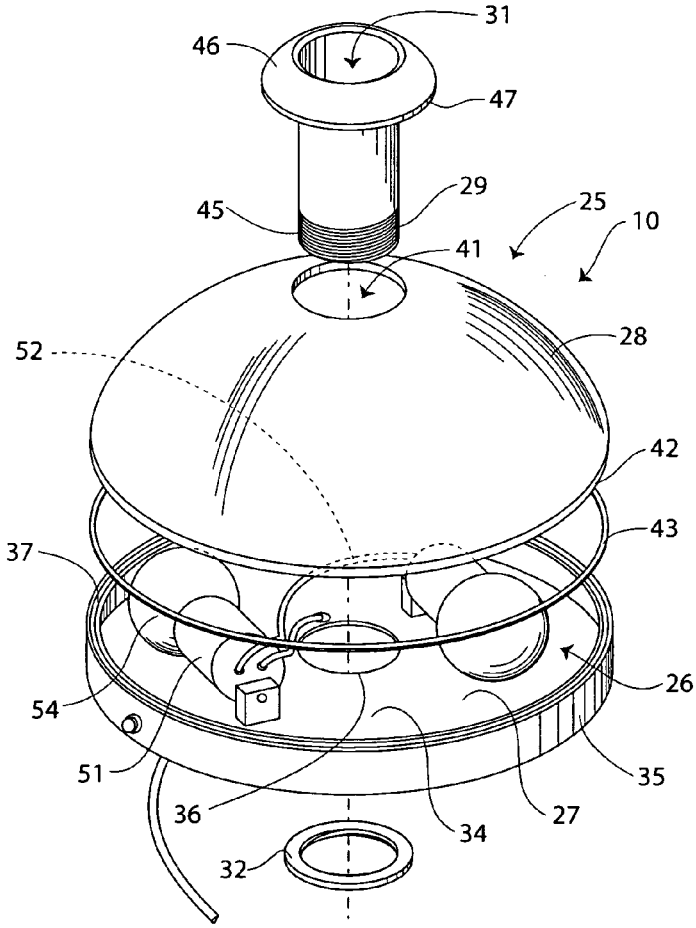
FIG. 3 is an exploded view of the light of FIG. 1.

With reference next to the drawings, there is shown an umbrella light 10 in a preferred form of the invention shown mounted to a conventional patio umbrella 11 and table 12. The umbrella 11 has a central pole 14 having a lower end adapted to be inserted into the bore of a conventional umbrella base 15. The umbrella 11 also includes an upper hub 16 permanently fixed or secured to the top of the pole 14, a lower hub or runner 18 that is adapted to slide along a portion of the vertical length of the pole 14 below the upper hub 18. In addition, the umbrella 11 includes a plurality of long ribs 19 extending radially from the upper hub 16 for supporting the umbrella covering 20 overlying the long ribs 19. The umbrella 11 also has a plurality of short ribs 22, each short rib 22 having an inner end pivotally connected to and extending radially from the lower hub 18, and an outer end that is pivotally connected to a corresponding long rib 19 at a location between the opposing ends of the long rib. The connections of the ribs 19 and 22 to each other, and to the hubs 16 and 18, can be accomplished in accordance with any of the constructions that are known in the art, and shall not be described in greater detail herein. The umbrella 11 is typically coupled to the table 12 by passing the central pole 14 through a central hole in the table 12 and into the umbrella base 15.

The light 10 has an external housing 25 and an internal light source 26 housed within the external housing 25. The external housing 25 includes an annular base plate 27, an annular dome shaped light diffuser 28, a tubular pole guide 29 defining an inside diameter or central bore 31, and a locking ring 32. It should be understood that the umbrella pole 14 has a select outside diameter which is smaller than the inside diameter of the pole guide bore 31.

The base plate 27 has a central floor 34 extending to a peripheral upright rim 35. The floor 34 has a central hole 36 therethrough. The upright rim 32 has a recess or groove 37 therein extending from its top end. The bottom surface of the base plate 27 is configured to have feet 38 which effectively raise the area of the base plate surrounding the central hole 36 from the underlying table 12.

The light diffuser 28 has a central hole 41 therein configured to be aligned with the central hole 36 of the base plate 27. The light diffuser 28 also has a peripheral lower edge or rim 42 configured to nest within the groove 37 of the base plate peripheral rim 35. An annular gasket 43 is positioned within the groove 37 so as to abut the lower edge 42 of the light diffusor so as to prevent moisture from passing between the light diffusor 28 and the base plate 27. The light diffuser 28 may be made of glass, plastic or any other suitable translucent or transparent material.

The pole guide 29 has an externally threaded bottom portion 45 and a peripheral top flange 46 configured to overlay a portion of the light diffusor defining the central hole 41. An annular rubber gasket 47 is mounted below the top flange 46 to prevent moisture from passing between the pole guide 29 and the light diffusor 28. The pole guide 29 has an overall length which enables the bottom portion 45 to extend through the central hole 36 in the base plate 27. The locking ring 32 has internal threads configured to mate with the external threads of the pole guide bottom portion 45.

The internal light source 26 includes two oppositely disposed electric light sockets 51 mounted to the top surface of the base plate 27. The light sockets 51 are conventionally coupled to an electric wire or power cord 52 also including an on/off and dimmer switch 53 and provided with electric light bulbs 54. The power cord 52 extends through a hole in the base plate 27 and terminates in a conventional electric plug. It should be understood that as an alternative the present invention may include a dc power source rather than the ac power source or access shown in the drawings.

In use, the light 10 is assembled with the locking ring 32 threaded onto the pole guide bottom portion 45 to prevent the separation of the light components, i.e., the light diffuser 28 is maintained tighly against the base plate by sandwiching the light diffuser and base plate between the top flange 46 and the locking ring 32. The light 10 may then be mounted onto the umbrella 11 by passing the umbrella pole 14 through the bore 31 of the tubular pole guide 29, thereby journaling the light 10 onto the umbrella pole 14. The light electric cord 52 is then passed through the central hole in the table 12 followed by passage of the umbrella pole 14 through the central hole in the table 12 and into the umbrella base 15. With the umbrella 11 mounted in this manner the light 10 rests upon the table 12 completely encircling the umbrella pole 14, thereby preventing the lateral movement of the light 10 upon the table 12. The electric cord 52 is then coupled to any conventional electric jack or extension cord.

As such, the light 10 is positioned to provide light to the area beneath the canopy of the umbrella, The light 10 will also be maintained in this position and prevented from falling off the table by the umbrella pole 14 passing through the center of the light 10.

It should also be understood that the light 10 may be journalled onto the central pole 14 in an inverted position and slid along the pole to a position adjacent the short ribs 22. The light 10 is then retained in this position with set screws, a clamp, hooks, or tethers extending between the light and the umbrella ribs to secure the light in this elevated position. With the light 10 in this position the illuminating light therefrom is directed downwardly towards the table 12.

The light bulbs 54 may be replaced by simply unthreading the locking ring 32 from the pole guide 29 so as to allow the light diffusor 28 to be separated from the base plate 27, thereby allowing access to the light bulbs.

It should also be understood that alternatively the light diffuser 28 may be made to include side walls extending to the base plate so as to define a central bore, rather than having the seperate pole guide 29 shown in the preferred embodiment.

It thus is seen that a light is now provided which illuminates the area beneath a patio umbrella and which is not susceptible to being knocked off a patio table to which the umbrella is mounted. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A combination light, patio umbrella and patio table, the combination comprising:

a patio table having a top surface with a hole therethrough;

a patio umbrella having a central pole configured to pass through said patio table hole; and a light having a housing with a translucent light diffusor, a base plate coupled to said light diffuser, and a tubular pole guide passing through said light diffusor and coupled to said base plate; and a light source mounted within said housing in a position to direct light through said translucent light diffusor, whereby the umbrella central pole is positioned within the pole guide of the housing to prevent lateral movement of the light relative to the central pole.

2. A light for use in conjunction with a patio umbrella having a central pole, the light comprising:

a housing having a translucent light diffuser, a base plate coupled to said light diffuser, and a tubular pole guide passing through said light diffuser and coupled to said base plate; and a light source mounted within said housing and positioned to direct light through said translucent light diffuser, whereby the umbrella central pole is positioned within the pole guide of the housing to prevent lateral movement of the light relative to the central pole.

3. A light for use in conjunction with a patio umbrella having a central pole of a select diameter, the light comprising:

a base plate having an opening therein;

a translucent light diffuser coupled to said base plate, said light diffuser having an opening therein aligned with said base plate opening;

a pole guide coupled to said base plate and light diffuser, said pole guide having a bore therethrough with an internal diameter larger than the diameter of the central pole; and a light source mounted between said light diffuser and said base plate.

4. The light of claim 3 further comprising a locking ring adapted to mate with said pole guide to lock said base plate to said light diffuser.

5. The light of claim 3 wherein said pole guide includes a peripheral flange configured to overly a portion of said light diffuser.

6. The light of claim 5 further comprising a locking ring adapted to mate with said pole guide to lock said base plate and said light diffuser between said peripheral flange and said ring.

7. The light of claim 5 wherein said peripheral flange includes a gasket.

* * * * *